United States Patent [19]

Prochnow et al.

[11] Patent Number: 4,858,520

[45] Date of Patent: Aug. 22, 1989

[54] AUXILIARY FRAME FOR CEILING MOUNTED AIR DIFFUSERS AND THE LIKE

[75] Inventors: Kenneth E. Prochnow; Richard C. Burke, both of Madison, Wis.

[73] Assignee: Carnes Company, Inc., Verona, Wis.

[21] Appl. No.: 154,851

[22] Filed: Feb. 10, 1988

[51] Int. Cl.[4] ..... F24F 13/06

[52] U.S. Cl. ..... 98/40.05; 98/40.1; 98/114

[58] Field of Search ..... 98/40.05, 40.07, 40.08, 98/40.09, 40.1, 40.11, 40.12, 40.14, 40.16, 40.17, 114; 362/147, 365

[56] References Cited

U.S. PATENT DOCUMENTS

| | | | |
|---|---|---|---|
| 1,411,628 | 4/1922 | Hug | 98/114 |
| 3,264,972 | 8/1966 | Averill et al. | 98/40.11 |
| 3,327,607 | 6/1967 | Newell et al. | 98/40.1 |
| 3,358,577 | 12/1967 | Thomson | 98/40.11 |
| 3,559,560 | 2/1971 | Trahan | 98/114 X |
| 3,744,396 | 7/1973 | Raider | 98/40.07 |
| 3,985,158 | 10/1976 | Felter | 138/149 |
| 4,188,656 | 2/1980 | Howard | 362/365 |
| 4,210,070 | 7/1980 | Tatum et al. | 98/40.05 |
| 4,406,216 | 9/1983 | Hott et al. | 98/116 |
| 4,713,916 | 12/1987 | Brooks, Jr. | 362/147 X |

OTHER PUBLICATIONS

"Titus Plenum Slot Diffusers Accessories", T-1021, Philips Industries, Inc., Jan. 1988.

*Primary Examiner*—Harold Joyce

*Attorney, Agent, or Firm*—Michael, Best & Friedrich

[57] ABSTRACT

An air distribution device system includes an air distribution device of rectangular configuration and an auxiliary frame adapted to flush-mount the air distribution device within a ceiling of the type wherein ceiling material is directly fastened to overlying structural members such as joists or rafters. The auxiliary frame is substantially rectangular in form and is fashioned from elongate frame members of T-shaped cross section. The vertical portions of the T-shaped frame members are fastened to the structural members so that the horizontal portions of the frame members are substantially coplanar with the ceiling. Thereafter, the air distribution device rests upon, and is supported by, the horizontal portions of the frame members. When desired, the air distribution device can be raised off the auxiliary frame to obtain access to the interior of the ceiling.

14 Claims, 1 Drawing Sheet

AUXILIARY FRAME FOR CEILING MOUNTED AIR DIFFUSERS AND THE LIKE

BACKGROUND OF THE INVENTION

This invention relates generally to air distribution devices and, more particularly, to air diffusers and arrangements for mounting such air diffusers in ceilings.

Ceiling mounted air distribution devices, such as diffusers, are widely used in the heating, ventilating and air conditioning systems of various types of structures. Often, the mounting of an air distribution device within the ceiling of a structure is complicated by the method employed in the construction of the structure.

In newly constructed non-residential structures, the most common form of ceiling is the "T-bar" type wherein a number of T-shaped elements are inverted and suspended in a grid-like pattern beneath the underside of an overhead structural ceiling. A number of typically rectangular or square ceiling panels are then supported between individual ones of the inverted T-shaped elements to form an attractive finish ceiling below the overhead structural ceiling. In such T-bar type ceilings, air distribution devices, as well as such other ceiling mounted devices as light fixtures and the like, can be mounted merely by resting the device within an area bounded by the T-bar elements. This simplifies construction, maintains asthetic quality and greatly contributes to economical construction.

Although ceilings of the T-bar type are most popular, a significant number of ceilings continue to be built by fastening a ceiling material directly to a framing material which often comprises a structural member such as a joist or rafter. In such ceilings, air distribution devices cannot be simply be rested on top of supporting elements as can be done in T-bar type ceilings but, rather, are typically inserted into an appropriately sized cut-out and secured with some form of fastener. To maintain asthetic quality, a decorative border is usually fastened around the cut-out and the edges of the air distribution device. In the past when the use of hard duct work was predominant, an air distribution device could be securely mounted by fastening the device directly to the rigid duct work. Today, when the use of flexible duct work is predominant, alternate means must be employed in order to securely mount an air distribution device within a T-bar type of ceiling.

One such known alternate method for flush mounting an air distribution device within a non T-bar type of ceiling included positioning framing materials over the cut-out and then fastening the diffuser to the framing materials thus positioned. Another known alternate method called for inserting screws upwardly into the ceiling through the exposed border of the diffuser. Still another known alternate method included securing a small section of hard duct within the cut-out and then securing the air distribution device to the duct in the manner previously used when hard ducts were common. All of these known alternate methods are time consuming and/or unattractive.

In view of the foregoing, it is a general object of the present invention to provide a new and improved system for flush-mounting an air distribution device within a ceiling of non T-bar construction.

It is a more specific object of the present invention to provide a new and improved system for flush mounting an air distribution device within a ceiling of non T-bar construction wherein the system provides T-bar type convenience in a non T-bar ceiling.

It is a still more specific object of the present invention to provide an auxiliary frame which permits air diffusers, originally designed for use in T-bar type ceilings, to be flush-mounted within ceilings of non T-bar construction.

SUMMARY OF THE INVENTION

The invention provides an air distribution device system for providing a flush-mounted air distribution device in a ceiling of the type having two or more substantially parallel framing members. The air distribution device system comprises a substantially rectangular closed-looped structure dimensioned to fit within a cut-out in the ceiling between the substantially parallel framing members and having a pair of substantially parallel side members and a pair of substantially parallel end members, the end and side members each being substantially T-shaped in cross section. The air distribution device system further comprises an air distribution device of substantially rectangular configuration dimensioned to fit within, and be supported by, the rectangular closed-looped structure when the structure is positioned within the cut-out in the ceiling and fastened between the substantially parallel framing members.

The invention also provides an auxiliary frame assembly for supporting an air distribution device in a ceiling of the type having two or more substantially parallel framing members. The auxiliary frame assembly comprises a substantially rectangular closed-looped structure dimensioned to fit between the substantially parallel framing members and having a pair of substantially parallel side members and a pair of substantially parallel end members, the side and end members each being substantially T-shaped in cross-section.

The invention also provides an auxiliary frame assembly for supporting an air distribution device in a ceiling of the type having two or more substantially horizontal substantially parallel framing members. The auxiliary frame includes a first elongate side member including a substantially vertical flange portion having upper and lower edges and further including a substantially horizontal flange portion adjoining the substantially vertical flange portion along the lower edge so as to give the first side member a substantially inverted T-shaped cross section. The auxiliary frame further includes a second elongate side member substantially similar to the first elongate side member positioned parallel to the first elongate side member and spaced from the first side member by a distance substantially equal to the distance between the two substantially parallel frame members of the ceiling. A first elongate end member, substantially similar in construction and cross-sectional shape to the first and second elongate side members, extends substantially perpendicularly between the ends of the first and second elongate side members. A second elongate end member, substantially similar to the first elongate end member, extends substantially perpendicularly between the remaining ends of the first and second elongate side members so as to form, with the first and second side members and the first end member, a substantially rectangular closed-loop structure. The auxiliary frame further includes means for mounting the substantially rectangular closed-looped structure between the substantially parallel frame members with the substantially horizontal flange portions of the first and second side members and the first and second end members positioned substantially coplanar with the ceiling.

A principal feature of the present invention is the provision of an air distribution device system wherein an air distribution device, originally intended for mounting within a ceiling of T-bar construction, can be conveniently and economically flush-mounted within a ceiling of non T-bar construction.

Another principal feature of the present invention is the provision of an auxiliary frame which permits the mounting of an air distribution device, originally intended for mounting within a ceiling of T-bar construction, within a ceiling of non T-bar construction.

Still another principal feature of the present invention is the provision of an auxiliary frame which provides T-bar type convenience in a ceiling of non T-bar construction.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 2:
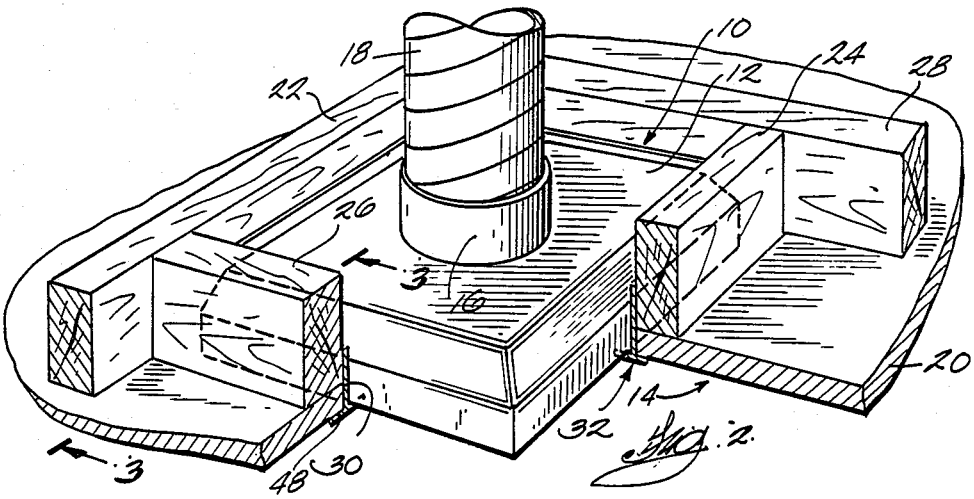
FIG. 2 is a perspective view, partially in section, of the air distribution device system illustrated in FIG. 1 showing the system mounted within a ceiling of non T-bar construction.
Figure 1:
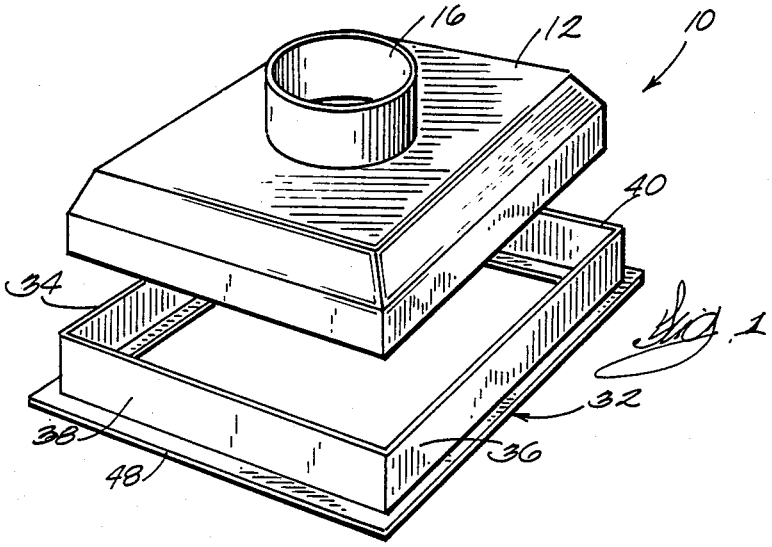
FIG. 1 is a perspective view of an air distribution device system including an auxiliary frame embodying various of the features of the invention.

Referring to the drawings, and in particular, to FIGS. 1 and 2, a system 10 for providing a flush-mounted air distribution device 12 in a ceiling 14 of the type having two or more substantially parallel framing members is illustrated. In the embodiment illustrated, the air distribution device 12 comprises a generally rectangular air diffuser having a circular inlet 16 adapted for connection to flexible duct work 18. It will be appreciated, however, that the system 10 can be used in connection with generally rectangular air distribution devices other than air diffusers.

As best seen in FIG. 2, the ceiling 14 is of the non T-bar type and comprises a layer of finish ceiling materials 20 fastened directly to a plurality of overlying framing members 22, 24, 26, and 28. A generally rectangular cut-out 30, dimensioned to receive the air distribution device 12, is formed in the finish ceiling material 20. At least two of the framing members 22 and 24 extend parallel to each other adjacent opposite sides of the rectangular cut-out 30, and additional framing members 26 and 28 can, if desired, be positioned adjacent the remaining opposite ends of the cut-out 30. It will be appreciated that the framing members 22–28 can comprise structural members such as joists or rafters and that the size of the cut-out 30 and of the air distribution device 12 can be matched to the standard spacing employed between such structural members.

Figure 3:
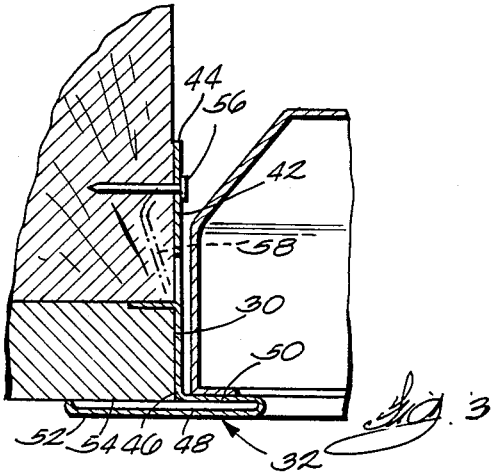
FIG. 3 is a cross-sectional view of the air distribution device system illustrated in FIG. 2 taken along line 3—3 thereof.
Figure 4:
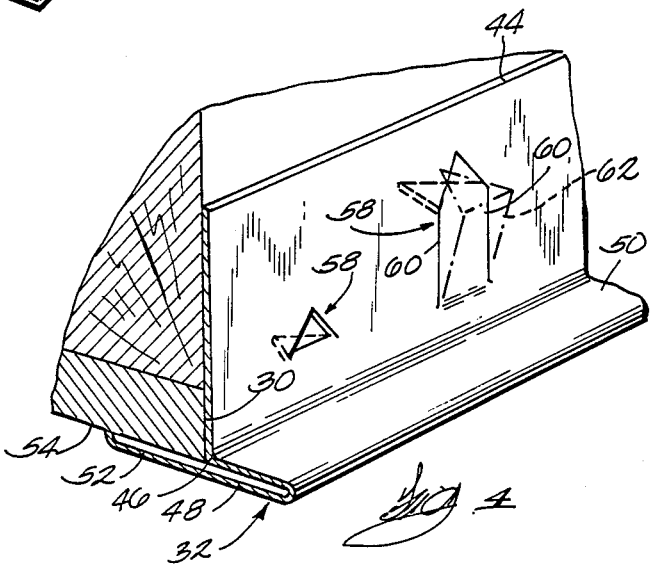
FIG. 4 is a perspective view, partially in section, of a portion of the auxiliary frame showing various additional details of the construction thereof.

The air distribution device 12 is flush mounted within the cut-out 30 by means of an auxiliary frame assembly 12 constructed in accordance with one aspect of the invention. As illustrated, the frame assembly 32 comprises a generally rectangular closed-looped structure dimensioned to fit within the cut-out 30 in the ceiling 14 between the substantially parallel framing members 22 and 24. The auxiliary frame 32 includes a pair of substantially parallel side members 34 and 36 and a pair of substantially parallel end members 38 and 40 mounted perpendicularly between the ends of the side members 34 and 36. As best illustrated in FIGS. 2, 3 and 4, each of the side and end members 34–40 comprises an elongate beam of substantially T-shaped cross-section. Preferably, each of the beams is roll formed from a suitable metal such as steel or aluminum, although extruded metal or plastic can also be utilized. As best seen in FIGS. 3 and 4, each side and end member includes a substantially vertical flange portion 42 having upper and lower edges 44 and 46 and a substantially horizontal flange portion 48 formed adjacent the lower edge 46 of the upper flange 42 and having an inner portion 50, upon which the air distribution device 12 rests, and an outer portion 52 which overlies the edge 54 formed by the ceiling cut-out 30 and thus provides an asthetically pleasing border. Preferably, the junctures of the side and end members 34–40 are secured by means of spot welding, although a snap mechanical fit at the corners of the auxiliary frame 32 can alternatively be employed.

The auxiliary frame 32 is secured within the ceiling 19 by means of a plurality of fasteners 56, such as screws or nails, extending through the vertical flange portions 42 and into the adjacent structural members 22–28. To facilitate such installation, a plurality of regularly spaced holes can be formed through the vertical flange portions 42. Preferably, the auxiliary frame 32 is pressed upwardly into the cut-out 30 so that the horizontal lower flange portion 48 of each of the side and end members 34–40 lies substantially coplanar with the underside of the finish ceiling material 20.

To improve the ease of installation, a plurality of integral lanced fingers 58 can be formed along the sides of the vertical flange portions 42 by cutting a series of slits 60 through the vertical flange portions 42. As illustrated in FIG. 4, the slits 60 can extend upwardly and come together at a point so as to form an upwardly extended pointed finger in the vertical flange portion 42 of the frame side and end members 34–40. Thereafter, the pointed finger 58 can be first displaced inwardly, and the pointed end thereafter bent outwardly, so as to form an outwardly directed pointed finger 62 as shown in phantom in FIG. 4. By forming a plurality of such fingers 58 at various locations along the vertical flange portions 42 of the side and end members 34–40 of the auxiliary frame 32, an installer can quickly and easily install the frame 32 by first pressing the frame 32 upwardly into the ceiling 14 through the cut out 30 and, then, while holding the frame 32 in position with one hand, rapping each of the lanced fingers 58 with a hammer to drive the fingers outwardly and into the adjacent framing members 22–28. This helps retain the auxiliary frame 32 in position and thereafter permits the installer to use both hands while permanently fastening the auxiliary frame 32 with the screws, nails or other fasteners 56. Alternatively, the fingers 58 can be biased outwardly as illustrated in phantom in FIG. 3 so as to provide a springlike friction fit for temporarily retaining the auxiliary frame 32 in position and so as to permit the installer to use both hands while inserting the screws, nails or other fasteners 56 through the vertical flange portion 42 and into the adjacent framing members 22–28.

Once the auxiliary frame 32 has been placed within the cut-out 30 and fastened to the framing members, the air distribution device 12 can be inserted diagonally through the frame 32 and thereafter dropped downwardly onto the inwardly extending horizontal flange portions 50 of the side and end members 34–40 to thereby support the air distribution device 12 as illustrated in FIGS. 2 and 3. If it should ever be necessary to gain access to the interior of the ceiling 14, such access can be attained by lifting the air distribution device 12 upwardly and away from the auxiliary frame 32.

It will be appreciated that, by suitably controlling the dimension of the auxiliary frame 32, the frame can permit the use, in non T-bar ceilings, of air distribution devices 12 originally intended for use in T-bar ceilings. It will also be appreciated that, because the air distribution device 12 is not permanently fixed to the auxiliary frame 32, but, rather, merely rests on the frame 32 under its own weight, the system 10 shown and described herein provides the convenience associated with T-bar ceilings in ceilings of non T-bar construction.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

We claim:

1. An air distribution device system for providing a flush-mounted air distribution device in a ceiling of the type having two or more substantially parallel framing members, said air distribution device system comprising:

a substantially rectangular closed-looped structure dimensioned to fit within a cut-out in the ceiling between the substantially parallel framing members and having a pair of substantially parallel side members and a pair of substantially parallel end members, said side and end members being connected to each other and each being substantially T-shaped in cross-section;

each of said first and second side and end members including a horizontal lower flange portion having an outwardly extending portion dimensioned to overlie the adjacent edge of the ceiling when said rectangular structure is positioned within the cut-out in the ceiling and having an inwardly extending portion on which an air distribution device rests when said rectangular structure supports said air distribution device;

means for mounting said rectangular closed-looped structure between the substantially parallel framing members with said lower flange portions of said first and second side and end members substantially coplanar with the ceiling;

means extending upwardly from said horizontal lower flange portions for connection with said framing members; and an air distribution device of substantially rectangular configuration dimensioned to fit within and rest upon the horizontal portions of said side and end members of said substantially rectangular closed-looped structure.

2. An air distribution device system in accordance with claim 1 wherein said means extending upwardly from said horizontal lower flange portions comprise a substantially vertical upper flange portion and wherein said mounting means comprises a fastener extending through said upper flange portion and into one of the substantially parallel framing members.

3. An air distribution device system in accordance with claim 2 wherein said upper flange portions of said first and second side members include lanced fingers for engaging the substantially parallel framing members and supporting said rectangular closed-looped structure within the cut-out and between the substantially parallel framing members.

4. An air distribution device system in accordance with claim 3 wherein said air distribution device comprises an air diffuser.

5. An auxiliary frame assembly for supporting a device in a ceiling of the type having two or more substantially parallel framing members, said auxiliary frame comprising a substantially rectangular closed-looped structure dimensioned to fit between the substantially parallel framing members and having a pair of substantially parallel side members and a pair of substantially parallel end members, said side and end members being connected to each other and each being substantially T-shaped in cross section, each of said side and end members including a horizontal lower flange portion having an outwardly extending portion dimensioned to overlie the adjacent edge of the ceiling when said rectangular structure is positioned within the cut-out in the ceiling and having an inwardly extending portion on which said device rests when said rectangular structure supports said device, means for mounting said rectangular closed-looped structure between the substantially parallel framing members with said lower flange portions of said side and end members substantially coplanar with the ceiling, and means extending upwardly from said horizontal lower flange portions for connection with said framing members.

6. An auxiliary frame assembly in accordance with claim 5 wherein said means extending upwardly from said horizontal lower flange portions comprise a substantially vertical upper flange portion and wherein said mounting means comprises a fastener extending through said upper flange portion and into one of the substantially parallel framing members.

7. An auxiliary frame assembly in accordance with claim 6 wherein said upper flange portions of said side members include lanced fingers for engaging the substantially parallel framing members and supporting said rectangular closed looped structure within the cut-out and between the substantially parallel framing members.

8. An auxiliary frame assembly for supporting a device in a ceiling, said auxiliary frame comprising:

a first elongate side member including a substantially vertical flange portion having upper and lower edges and further including a substantially horizontal flange portion adjoining said substantially vertical flange portion along said lower edge so as to give said first side member a substantially inverted T-shaped cross-section;

a second elongate side member substantially similar to said first elongate side member positioned parallel to said first elongate side member and spaced from said first side member;

a first elongate end member substantially similar in construction and cross-sectional shape to said first and second elongate side members and extending substantially perpendicularly between the ends of said first and second elongate side members;

a second elongate end member substantially similar to said first elongate end member and extending substantially perpendicularly between the remaining ends of said first and second elongate side members so as to form, with said first and second side members and said first end member, a substantially rectangular closed-looped structure for engaging and supporting the device;

means for connecting the respective ends of said first and second side members to respective ends of said first and second end members so that said side and end members form a unitary support frame; and means for mounting said substantially rectangular closed-loop structure within the ceiling with said substantially horizontal flange portions of said first and second side members and said first and second end members positioned substantially coplanar with the ceiling.

9. An auxiliary frame assembly in accordance with claim 8 wherein said first and second side members, and said first and second end members, each comprises an extruded member.

10. An auxiliary frame assembly in accordance with claim 8 wherein each of said first and second side members, and said first and second end members, are formed through the process of roll forming.

11. An auxiliary frame assembly in accordance with claim 8 wherein the ceiling includes two or more substantially horizontal, substantially parallel framing members and wherein said mounting means includes a fastener adapted to extend through said vertical flange portion of one of said first and second side members and into one of the substantially horizontal, substantially parallel framing members.

12. An auxiliary frame assembly in accordance with claim 8 wherein the ceiling includes two or more substantially horizontal, substantially parallel framing members and wherein said mounting means includes a lanced finger on said vertical flange portions of said first and second side members and adapted to engage the substantially horizontal, substantially parallel framing members of the ceiling.

13. An auxiliary frame assembly in accordance with claim 12 wherein said lanced fingers extend inwardly of said substantially rectangular closed-looped structure and are adapted to be driven outwardly into the substantially horizontal, substantially parallel framing members.

14. An auxiliary frame assembly in accordance with claim 12 wherein said fingers are biased outwardly of said substantially rectangular closed-looped structure so as to frictionally engage the substantially horizontal, substantially parallel framing members of the ceiling.

* * * * *